United States Patent [19]

Gruhn

[11] Patent Number: 4,596,897

[45] Date of Patent: Jun. 24, 1986

[54] ELECTRICAL SHIELDING TAPE WITH INTERRUPTED ADHESIVE LAYER AND SHIELDED CABLE CONSTRUCTED THEREWITH

[75] Inventor: Joel D. Gruhn, Hickory, N.C.

[73] Assignee: Neptco Incorporated, Pawtucket, R.I.

[21] Appl. No.: 589,672

[22] Filed: Mar. 12, 1984

[51] Int. Cl.[4] ..... H01B 7/34

[52] U.S. Cl. ..... 174/36; 174/115; 174/117 F; 174/117 A; 428/209; 428/344

[58] Field of Search ..... 174/36, 115, 117 A, 174/117 F; 156/54, 291; 428/209, 344, 295

[56] References Cited

U.S. PATENT DOCUMENTS

| | | | |
|---|---|---|---|
| 1,445,070 | 2/1923 | Clune | 156/291 |
| 2,205,600 | 6/1940 | Payzant | 156/291 X |
| 3,152,035 | 10/1964 | Kirschner | 428/209 |
| 3,274,329 | 9/1966 | Timmons | 174/36 |
| 3,413,405 | 11/1968 | Myers | 174/36 |
| 3,497,383 | 2/1970 | Olyphant, Jr. et al. | 174/117 A |
| 3,505,144 | 4/1970 | Kilduff et al. | 428/344 X |
| 3,612,743 | 10/1971 | Angele | 174/36 |
| 3,662,090 | 5/1972 | Grey | 174/102 R X |
| 3,770,570 | 11/1973 | Swearingen et al. | 428/209 |
| 4,096,346 | 6/1978 | Stine et al. | 174/36 |
| 4,209,215 | 6/1980 | Verma | 174/35 R |

FOREIGN PATENT DOCUMENTS 61829 10/1982 European Pat. Off. ..... 174/117 F

*Primary Examiner*—Arthur T. Grimley
*Assistant Examiner*—Morris H. Nimmo
*Attorney, Agent, or Firm*—Salter & Michaelson

[57] ABSTRACT

An electrical shielding tape comprises a polyester backing layer, and a metallic layer having an adhesive on the exposed surface thereof, the adhesive being disposed in an interrupted layer which defines both exposed open patches, or contact pads, and coated bonding areas thereon. The tape is constructed for use in a shielded cable of the type having at least one conductor wire and an uninsulated drain wire, wherein the tape is wrapped around the conductor and drain wires with the metallic surface of the tape facing inwardly and with the tape adhesively secured to the conductor and drain wires by means of the adhesive on the metallic surface thereof. Effective electrical contact between the tape and the drain wire is achieved in the open patches, or contact pads, which contact the drain wire, and therefore the tape can be grounded to achieve the desired shielding effects simply by connecting the drain wire to a ground terminal. Preferably the exposed contact areas or patches are substantially unconnected on the inwardly facing metallic surface so that the adhesive effectively seals the cable against moisture penetration.

7 Claims, 5 Drawing Figures

FIG. 1
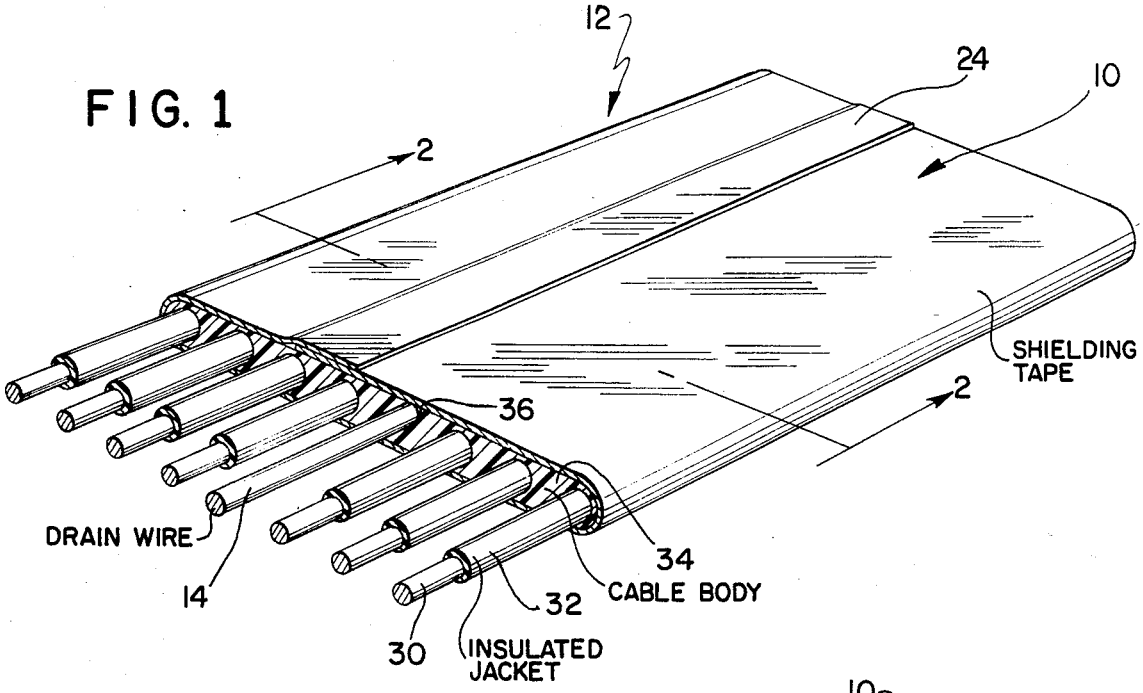
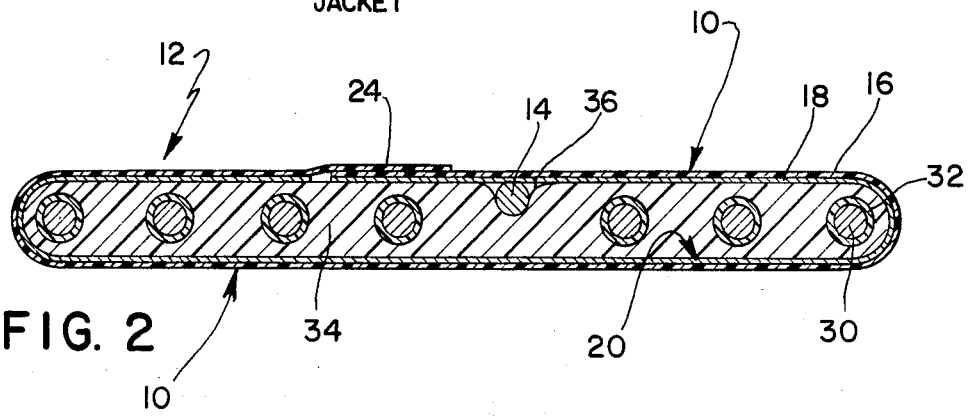
FIG. 2
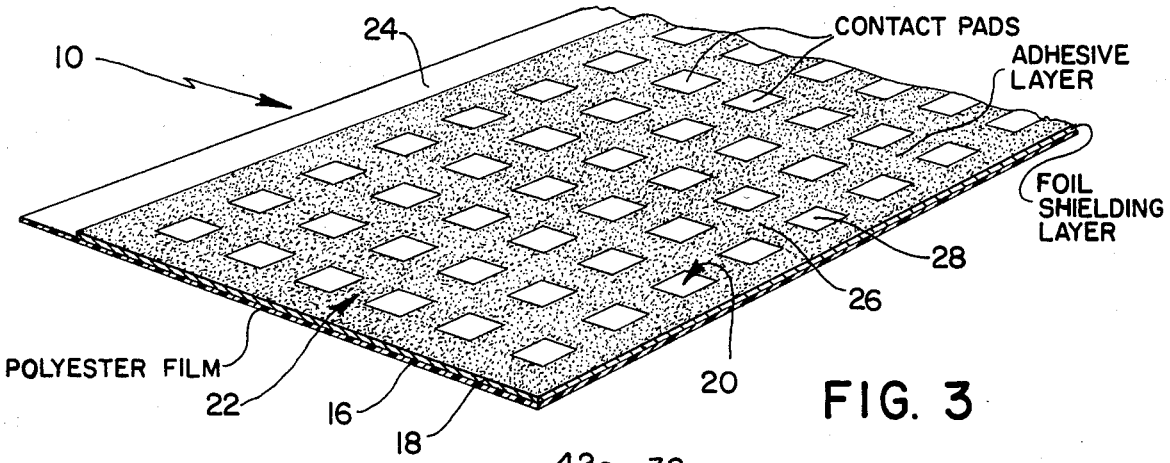
FIG. 3
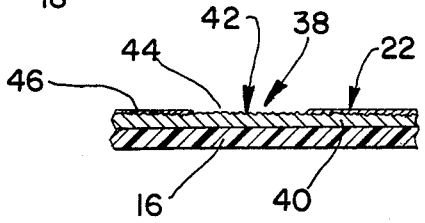
FIG. 4

ELECTRICAL SHIELDING TAPE WITH INTERRUPTED ADHESIVE LAYER AND SHIELDED CABLE CONSTRUCTED THEREWITH

BACKGROUND AND SUMMARY OF THE INVENTION

The instant invention relates to the shielding of electrical conductors against the ingress and egress of electromagnetic radiation and more particularly to a novel electrical shielding tape and a novel shielded electrical cable constructed therewith.

The use of metallic shielding tapes in shielded cable constructions is generally known in the electrical industry, and in this regard, reference is made to the applicant's copending U.S. patent application No. 541,361 filed on Oct. 11, 1983 and entitled "Electrical Shielding Tape and Shielded Electrical Cable Constructed Therewith". Further in this regard, a variety of other different electrical shielding tapes have been used in shielded cable constructions for various applications. Generally, the known shielding tapes have been applied in various wrapped dispositions around conductor wires in cables for providing the desired shielding effects against electromagnetic radiation, and external casings or the like have been applied in the cables over the tapes for providing protection against physical damage. In most applications, shielding tapes have been applied to cables in either longitudinally extending "cigarette" wrapped dispositions or in spirally wrapped dispositions, the important point in either case being to provide complete continuous metallic shields around the conductor wires in the respective cables. In most cases, metallic shielding tape constructions have comprised laminations of relatively thin metallic foil layers for shielding, such as aluminum foil layers, and insulative polyester film backing layers which have provided strength and durability in the tapes. Tapes of this type have generally been applied around insulated conductor wires with the foil layers of the tapes facing inwardly, and with the insulative backing layers thereof facing outwardly so that the outer surfaces of the tapes are insulated by the polyester layers. Generally, shielding tapes of this type have been adhesively bonded around inner insulated conductors in shielded cable constructions to firmly secure the tapes in the respective cables, as well as to seal the conductors against moisture penetration which might otherwise take place as a result of capillary action or "wicking" effects. However, one problem which has been experienced in shielded cable constructions of the type comprising foil shielding tapes is the fact that it is difficult to electrically connect foil tapes to ground terminals at the ends of cables, which is necessary in order to achieve the desired shielding effects. While various types of terminal connectors have been available for connection to the shielding layers of shielded cables, they have generally not been effective for making reliable electrical contacts to the thin foil layers of shielding tapes. In order to overcome this problem, some tape-shielded cables have included longitudinally extending uninsulated drain wires which are positioned in physical contact with the inner surfaces of the respective tapes substantially along the entire extents thereof. These drain wires have been provided principally for simplifying electrical interconnections between foil shielding tapes in cables and ground terminals, since drain wires are easily connectable to terminals by conventional means. Unfortunately, however, it has been found that virtually all of the adhesives used for securing shielding tapes in shielded cables have characteristically functioned as electrical insulators, and therefore in cable constructions wherein shielding tapes have been adhesively bonded around conductors, electrical contact between the tapes and the respective drain wires has been hampered by the insulative effects of these adhesives. Accordingly, reliable grounding connections have not always been possible, even in foil shielded cable constructions which have included drain wires.

The instant invention provides a novel solution to the problem of achieving a reliable ground connection in a foil shielded cable by providing a foil shielding tape which is constructed so that it can be adhesively secured in a cable in a manner which provides effective electrical contact with a drain wire in the cable. The electrical shielding tape of the instant invention comprises a metallic shielding layer having an adhesive layer on the inwardly disposed surface thereof for securing the tape in a cable. The adhesive is, however, disposed on the surface in an interrupted layer which defines both exposed contact areas or pads and coated bonding areas thereon; and accordingly, when the tape is used in a cable construction, the bonding areas effectively secure the tape in the cable, but electrical contact between the tape and a drain wire in the cable is provided in the exposed contact pads on the metallic surface of the tape. Preferably the exposed contact pads are disposed in a substantially uniform pattern of contact pads or localized open patches which are on the metallic surfaces discrete areas which are surrounded by adhesive, such as a pattern defined by a plurality of adjacent rows of spaced contact pads wherein the contact pads in adjacent rows are in staggered spaced relation, or a pattern defined by a plurality of spaced rows of spaced contact pads. As a result, the longitudinal penetration of moisture along the cable through wicking effects or capillary action is avoided, because the adhesive effectively seals the cable against such longitudinal penetration. However, effective electrical contact can be reliably achieved in the contact pads between the tape and the drain wire. Accordingly, it is seen that the shielding tape of the instant invention and the shielded cable of the instant invention constructed therewith effectively solve the problem of grounding a foil shielding tape in a reliable manner.

Accordingly, it is a primary object of the instant invention to provide a metallic foil shielding tape which can be adhesively secured in a shielded cable construction so that it is in effective electrical contact with a drain wire in the cable.

Another object of the instant invention is to provide a shielded cable construction of the type having a metallic foil shielding tape which is adhesively secured therein, wherein the shielding tape can be reliably connected to a ground terminal.

Another object of the instant invention is to provide a shielded cable construction, of the type having a foil shielding tape, which can be effectively grounded and which is not susceptible to moisture penetration.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention:

FIG. 1 is a pespective view of the shielded cable construction of the instant invention;

FIG. 2 is a sectional view taken along line 2—2 in FIG. 1;

FIG. 3 is a perspective view of a first embodiment of the foil shielding tape of the instant invention;

FIG. 4 is a sectional view of a second embodiment of the shielding tape of the instant invention.

DESCRIPTION OF THE INVENTION

Figure 5:
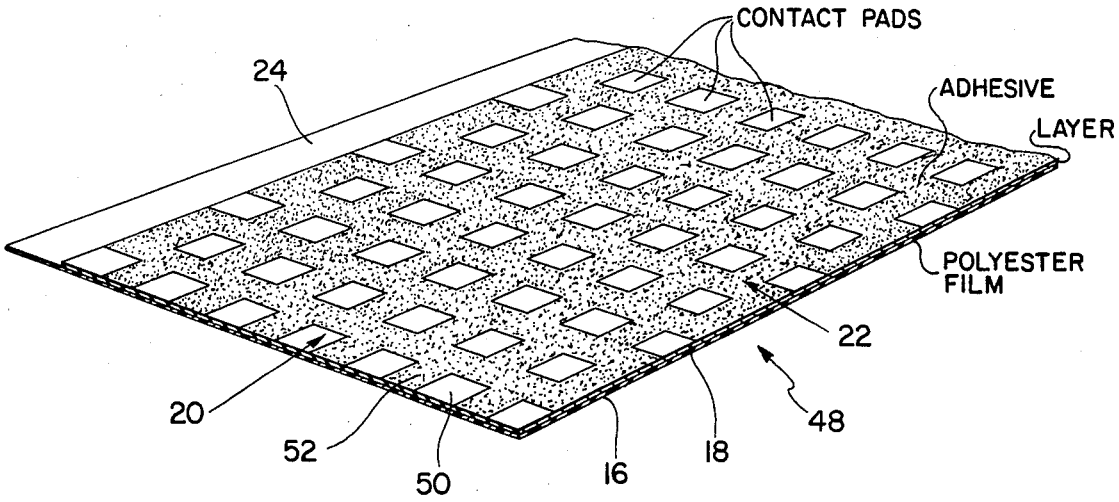
FIG. 5 is a perspective view of a third embodiment of the shielding tape of the instant invention.

Referring now to the drawing, a first embodiment of the foil shielding tape of the instant invention is illustrated in FIG. 3 and generally indicated at 10, and the shielded cable construction of the instant invention which is constructed with the tape 10 is illustrated in FIGS. 1 and 2 and generally indicated at 12. The tape 10 is longitudinally or "cigarette" wrapped in the cable 12 for providing a reliable shield against the ingress and egress of electromagnetic radiation. In this regard, the tape 10 is adhesively secured in the cable 12 in a manner which will hereinafter be described which permits the effective electrical interconnection of the tape 10 to a ground terminal through a drain wire 14 in the cable 12 for providing the desired shielding effects.

The tape 10 preferably comprises a backing layer 16 comprising a flexible polyester film, such as Mylar (du-Pont t.m.) or the like, and a shielding layer 18 which is adhesively secured on the backing layer 16. The shielding layer 18 preferably comprises a metallic foil layer, such as an aluminum foil layer, having a metallic surface 20 thereon, and an adhesive 22 which is disposed in a relatively thin interrupted layer (preferably in the range of 0.00005 to 0.001 inch thick) on the surface 20. While the layer 18 herein illustrated comprises only a single lamination of metallic foil, it will be understood that other embodiments of the tape of the instant invention are contemplated wherein the shielding layer 18 comprises a laminated layer which includes a lamination of polyester, such as Mylar, or the like, as well as a metallic foil lamination which is adhesively secured on the polyester lamination, as is generally known in the art. The important feature with regard to the shielding layer 18 is, however, that themetallic surface 20 with the adhesive 22 thereon defines one side of the tape 10. In the preferred embodiment, the tape 10 is constructed so that the shielding layer 18 and the backing layer 16 are dimensioned and oriented so that a longitudinally extending border 24 is defined along one edge of the tape 10 where the backing layer 16 extends slightly beyond the shielding layer 18.

While shielding tapes having backing layers and shielding layers have generally been heretofore known in the art, the feature which distinguishes the tape 10 from the heretofore known tapes of this general type is the fact that the adhesive 22 is disposed in an interrupted pattern on the surface 20. Specifically, the adhesive 22 is disposed on the surface 20 so that both coated bonding, areas 26 and exposed open contact pads or contact areas 28 are defined thereon, the contact pads 28 being slightly recessed with respect to the bonding areas 26 due to the thickness of the adhesive 22. Preferably also the exposed contact areas or pads 28 are disposed in a substantially uniform pattern wherein adjacent contact pads 28 are substantially unconnected or discrete areas on the surface 20, such as the pattern illustrated in FIG. 3, which is defined by a plurality of rows of spaced contact pads 28 on the surface 22. Although the construction of tapes with a variety of other adhesive patterns is contemplated, it should be pointed out that preferably the contact pads 28 comprise discrete localized open "patches" in the adhesive 22 which individually are surrounded by the adhesive 22 on the surface 20 do not extend substantial distances either transversely or longitudinally with respect to the tape 10.

The cable 12 comprises a plurality of conductor elements 30 having insulated jackets 32 thereon, a cable body 34, the drain wire 14, and the tape 10. The cable 12 herein disclosed is a substantially flat shielded cable, and therefore the conductor elements 30 are embedded in the body 34 in a substantially aligned row. The drain wire 14 is disposed in a longitudinal groove 36 in the cable 12 so that it extends along one side of the body 34, being exposed along one side thereof rather than being fully embedded in the body 34. The tape 10 is received on the body 34 in a "cigarette"-wrapped longitudinally extending disposition, and it is preferably dimensioned so that the shielding layer 18 extends substantially around the body 34, and so that the border 24 overlaps and is adhesively bonded to a portion of the backing layer 16 adjacent the opposite longitudinal edge of the tape 10. In this regard, the tape 10 is positioned so that the surface 20 faces inwardly towards the body 34 and the drain wire 14, and the tape 10 is adhesively secured on the body 34 with the adhesive 22 in the coated bonding pads 26 so that the shielding layer 18 effectively shields the conductor elements 30 and so that it extends along the drain wire 14, being in electrical contact therewith by virtue of the exposed contact areas 28 adjacent thereto. It should be pointed out that although the cable 12 herein illustrated is a flat cable, the embodiment of the instant invention in cables of other configurations which include similarly positioned drain wires is also contemplated.

A second embodiment of the shielding tape of the instant invention is illustrated in FIG. 4 and generally indicated at 38. The tape 38, which can be used in shielded cable constructions similar to the cable 12, comprises a backing layer 16, a metallic shielding layer 40, having a metallic surface 42 thereon and an adhesive 22 on the surface 42. The shielding layer 40 is adhesively secured on the backing layer 16 so that the surface 42 defines one side of the tape 38, and the adhesive 22 is disposed in an interrupted layer which defines both exposed contact or pads 44 and coated bonding areas 46 on the surface 42. The contact and bonding areas 44 and 46, respectively, are preferably disposed in an interrupted pattern wherein adjacent contact pads 44 are discrete or spaced on the surface 42, such as the pattern illustrated in FIG. 3 for the tape 10. The shielding layer 40 in the tape 38 comprises an embossed shielding layer having an irregular or textured surface configuration on the surface 42 thereof as illustrated, and therefore the tape 38 differs from the tape 10 in this respect. Accordingly, when the tape 38 is applied in a shielded cable construction similar to that illustrated in FIGS. 1 and 2, enhanced electrical contact between the layer 40 and a drain wire 14 is achieved. The adhesive 22, which prefereably comprises a relatively thin, interrupted layer (preferably within the range of 0.00005 to 0.001 inch thick) does not have a negative effect on the contact achieved between the slightly recessed contact areas 44 and the drain wire 14. In addition, because of the textured aspect of the surface 42, improved electrical contact is provided which might, in some instances, otherwise be affected by the presence of surface oxides on the metallic foil 40.

A third embodiment of the shielding tape of the instant invention is illustrated in FIG. 5 and generally indicated at 48. The tape 48 is generally similar to the tape 10, including a backing layer 16, a shielding layer 18 adhesively secured on the backing layer 16, and an adhesive 22 on the surface 20 of the shielding layer 18. However, in the tape 48, the adhesive 22 is disposed in a pattern defined by a plurality of adjacent rows of spaced contact areas or pads 50 and coated bonding areas 52, wherein the contact areas or pads 50 in adjacent rows are in staggered spaced relation. By providing a pattern of adhesive 22 of this type on the surface 20, the tape 48 can be applied in virtually any longitudinally extending disposition in a cable construction without concern with regard to properly orienting the tape 48 with respect to a drain wire in the cable, since proper contact with the drain wire is virtually assured by the pattern of the adhesive 22. Further, it has been found that the bonding areas 52 in the tape 48 provide effective adhesive bonding to prevent moisture penetration in a cable.

It is seen, therefore, that the tapes 12, 38 and 48, and the shielded cable 12 effectively solve the problem of electrically interconnecting a metallic shielding tape in a tape-shielded cable to a ground terminal. By providing a shielding tape having an adhesive which is disposed on a metallic surface of the tape in an interrupted layer which includes both exposed contact areas or pads and coated bonding areas or pads thereon, effective electrical contact between the tape and a drain wire in a cable can be achieved. Further, effective electrical interconnection between a tape and a drain wire, specifically the metallic foil layer thereof, is achieved at a plurality of spaced points substantially along the entire extent of the tape, so that even if contact is ineffective in one area of a cable, there is sufficient contact over the length of the cable to provide effective grounding with the drain wire. In addition to providing a shielding tape which can be effectively electrically interconnected to a drain wire, the instant invention provides a shielded cable construction which is nevertheless highly resistant to penetration by moisture. Specifically, because the exposed contact areas 28, 44, and 50 are disposed in interrupted patterns wherein adjacent contact areas are unconnected, the shielded cable of the instant invention constructed with either of the tapes 10, 38 and 48 is resistant to moisture penetration caused by wicking effects or capillary action. In this regard, it will be noted that because the contact pads 28, 44 and 50 are unconnected on their respective surfaces, the adhesives 22 in the tapes 10, 38, and 48 provide barriers or seals against longitudinal moisture penetration in cables constructed therewith. Accordingly, for all of the above reasons, it is seen that both the metallic shielding tapes of the instant invention and the shielded cables constructed therewith represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A shielded cable construction comprising:

a. an elongated conductor wire;

b. an uninsulated drain wire coextending with said conductor wire; and c. a metallic shielding tape extending around said conductor wire and said drain wire, said tape having a metallic layer with an inwardly facing metallic surface and an adhesive on said surface for securing said tape, said adhesive being applied over preselected portions of said surface, the uncoated portions defining slightly recessed, localized contact pads wherein said surface is exposed, said tape making electrical contact with said drain wire in at least a portion of said exposed contact pads.

2. In the cable construction of claim 1, said exposed contact pads further characterized as discrete pads on said surface.

3. In the cable construction of claim 1, said adhesive being disposed in a substantially uniform pattern of coated bonding areas and said exposed contact pads, said exposed contact pads further characterized as discrete pads.

4. In the cable construction of claim 3, said contact pads being disposed in a plurality of rows of said spaced contact pads.

5. In the cable construction of claim 1, said contact pads being disposed in a plurality of adjacent rows of said spaced contact pads wherein the contact pads in adjacent rows are in staggered spaced relation.

6. In the cable construction of claim 1, said metallic surface further characterized as being embossed in at least a portion of said exposed contact pads.

7. In the cable construction of claim 1, said contact pads further characterized as being defined by localized open patches in said adhesive layer which are surrounded by adhesive on said surface.

* * * * *